US009140281B1

(12) United States Patent
Schaar

(10) Patent No.: US 9,140,281 B1
(45) Date of Patent: Sep. 22, 2015

(54) BISYNCHRONOUS COMPOUND BOW WITH NO LIMB-PULLEY TORQUE AND ENHANCED LIMB ENERGY STORAGE

(71) Applicant: John Graham Schaar, Tempe, AZ (US)

(72) Inventor: John Graham Schaar, Tempe, AZ (US)

( * ) Notice: Subject to any disclaimer, the term of this patent is extended or adjusted under 35 U.S.C. 154(b) by 0 days.

(21) Appl. No.: 14/120,489

(22) Filed: May 27, 2014

(51) Int. Cl.
*F41B 5/10* (2006.01)
*F16B 5/10* (2006.01)

(52) U.S. Cl.
CPC ..... *F16B 5/10* (2013.01)

(58) Field of Classification Search
CPC ..... F41B 5/10; F41B 5/105; F41B 5/0094; Y10S 124/90
USPC ..... 124/25.6
See application file for complete search history.

(56) References Cited

U.S. PATENT DOCUMENTS

| | | | | |
|---|---|---|---|---|
| 3,993,039 | A | 11/1976 | Groves | |
| 4,227,509 | A | 10/1980 | Jones | |
| 4,368,718 | A | 1/1983 | Simonds | |
| 4,440,142 | A | 4/1984 | Simonds | |
| 4,457,288 | A | 7/1984 | Ricord | |
| 4,541,401 | A | 9/1985 | Caldwell | |
| 4,649,890 | A | 3/1987 | Powers | |
| 4,660,536 | A | 4/1987 | McPherson | |
| 4,669,445 | A | 6/1987 | Schaar | |
| 4,971,020 | A * | 11/1990 | Soderstrom et al. | 124/23.1 |
| 5,368,006 | A | 11/1994 | McPherson | |
| 6,443,139 | B1 | 9/2002 | McPherson | |
| 6,470,870 | B1 | 10/2002 | Schaar | |
| 6,659,096 | B1 | 12/2003 | Nealy et al. | |
| 6,715,479 | B1 * | 4/2004 | Bunk | 124/25.6 |
| 6,792,930 | B1 | 9/2004 | Kronengold | |
| 6,792,931 | B1 | 9/2004 | Schaar | |
| 7,891,349 | B1 | 2/2011 | Kronengold | |
| 8,176,906 | B2 | 5/2012 | Simo | |
| 8,402,960 | B2 | 3/2013 | McPherson | |
| 8,522,762 | B2 * | 9/2013 | Trpkovski | 124/25.6 |

* cited by examiner

*Primary Examiner* — Alvin Hunter
*Assistant Examiner* — Amir Klayman

(57) ABSTRACT

A bisynchronous compound archers bow configured so that no torsion related forces from the operation of the pulleys mounted proximate the ends of the bows limbs ever registers in the bows limbs, pulleys, axles or bowstring, so that no pulley related torsion is ever transmitted by way of the bowstring to arrows as they are being propelled from the bow, and further configured so that as a result of operating the limb-pulley system the amount of energy stored in each limb of a given length, width, thickness, and material of the bow is significantly increased when compared to the amount of energy stored in compound bow limbs of the same length, width, thickness, and materials in prior art compound bows. Typical increases in energy storage of limbs of a given length, width, thickness and materials of this invention will be double or more the energy achievable with similar limbs and pulleys if configured as in prior art bisynchronous compound bows. This feature allows limbs of reduced thickness to store the required amount of energy for a given draw weight bow, and the thinner and lighter limbs register less shock and vibration in the system enabling bows of the invention to shoot more quietly than prior art compound bows.

1 Claim, 13 Drawing Sheets

PRIOR ART

PRIOR ART

PRIOR ART

PRIOR ART

PRIOR ART

FRONT QUARTERING VIEW

REAR QUARTERING VIEW

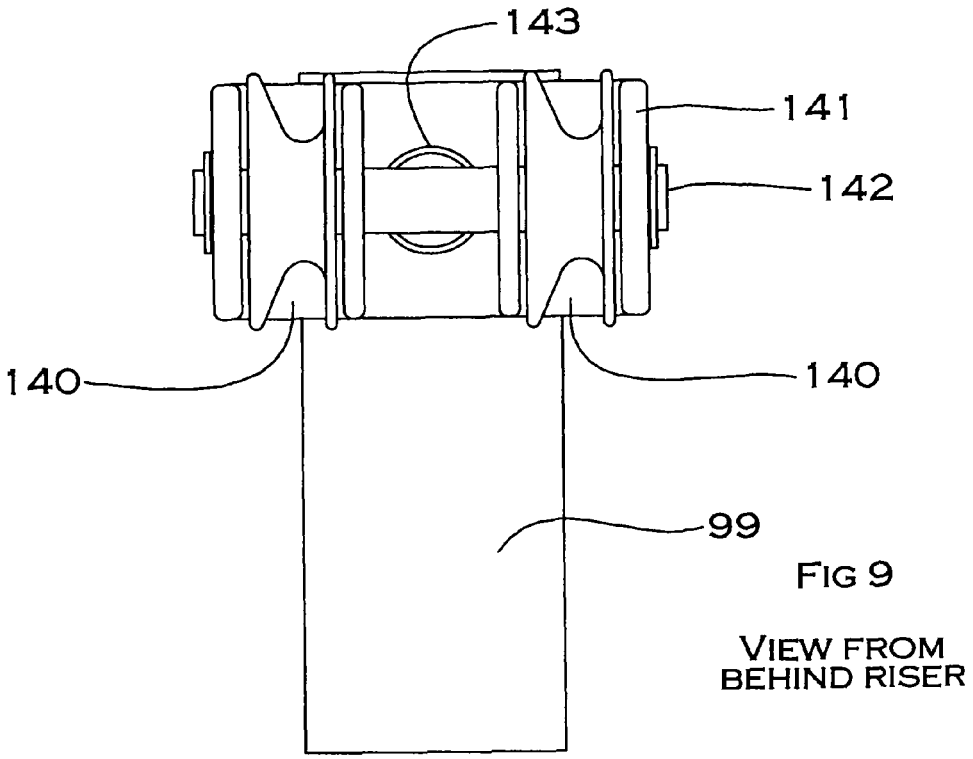
FIG 9
VIEW FROM BEHIND RISER
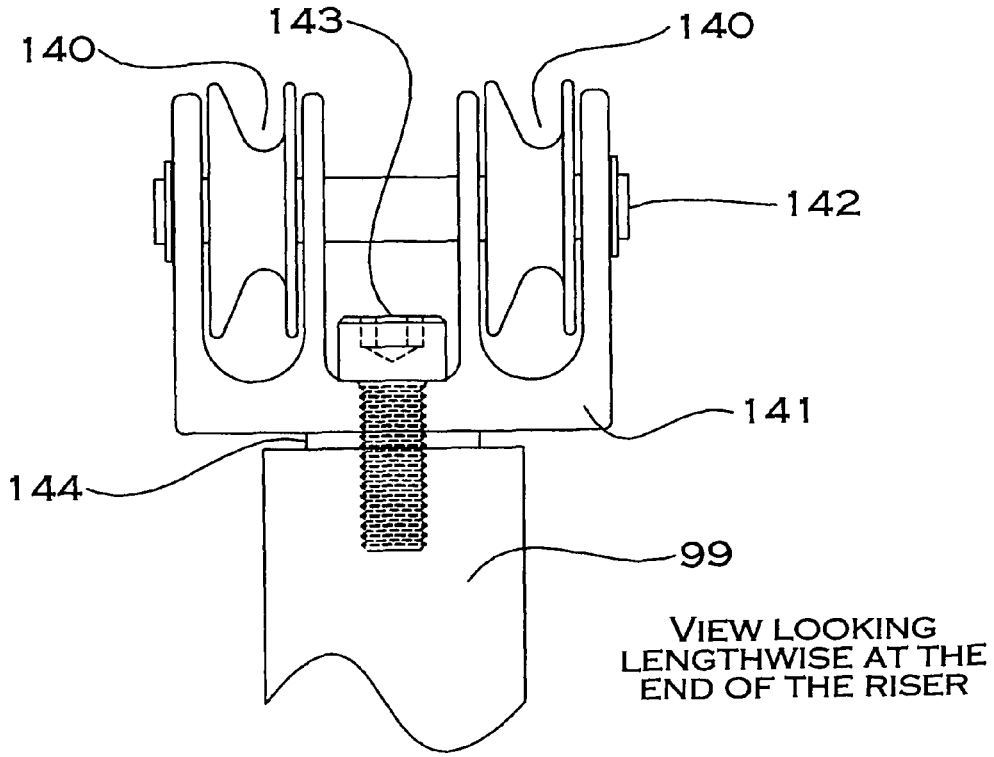
VIEW LOOKING LENGTHWISE AT THE END OF THE RISER

BISYNCHRONOUS COMPOUND BOW WITH NO LIMB-PULLEY TORQUE AND ENHANCED LIMB ENERGY STORAGE

PRIOR ART CITATIONS

U.S. Pat. No. 3,993,039 Groves Nov. 23, 1976*
U.S. Pat. No. 4,227,509 Jones Oct. 14, 1980*
U.S. Pat. No. 4,368,718 Simonds Jan. 18, 1983
U.S. Pat. No. 4,440,142 Simonds Apr. 3, 1984
U.S. Pat. No. 4,457,288 Ricord Jul. 3, 1984
U.S. Pat. No. 4,541,401 Caldwell Sep. 17, 1985
U.S. Pat. No. 4,649,890 Powers Mar. 17, 1987*
U.S. Pat. No. 4,660,536 McPherson Apr. 28, 1987
U.S. Pat. No. 4,669,445 Schaar Jun. 2, 1987
U.S. Pat. No. 5,368,006 McPherson Nov. 29, 1994
U.S. Pat. No. 6,443,139 McPherson Sep. 3, 2002
U.S. Pat. No. 6,470,870 Schaar Nov. 29, 2002*
U.S. Pat. No. 6,659,096 Nealy et al Dec. 9, 2003
U.S. Pat. No. 6,792,930 Kronengold Sep. 21, 2004
U.S. Pat. No. 6,792,631 Schaar Sep. 21, 2004*
U.S. Pat. No. 7,891,349 Kronengold Feb. 22, 2011
U.S. Pat. No. 8,176,906 Simo May 15, 2012
U.S. Pat. No. 8,402,960 McPherson Mar. 26, 2013

* denotes asynchronous operation

BRIEF DESCRIPTION OF THE DRAWINGS

Brief Description of Drawings Relating to Prior Art

Brief Description of Drawings Relating to the Invention

Figure 5:
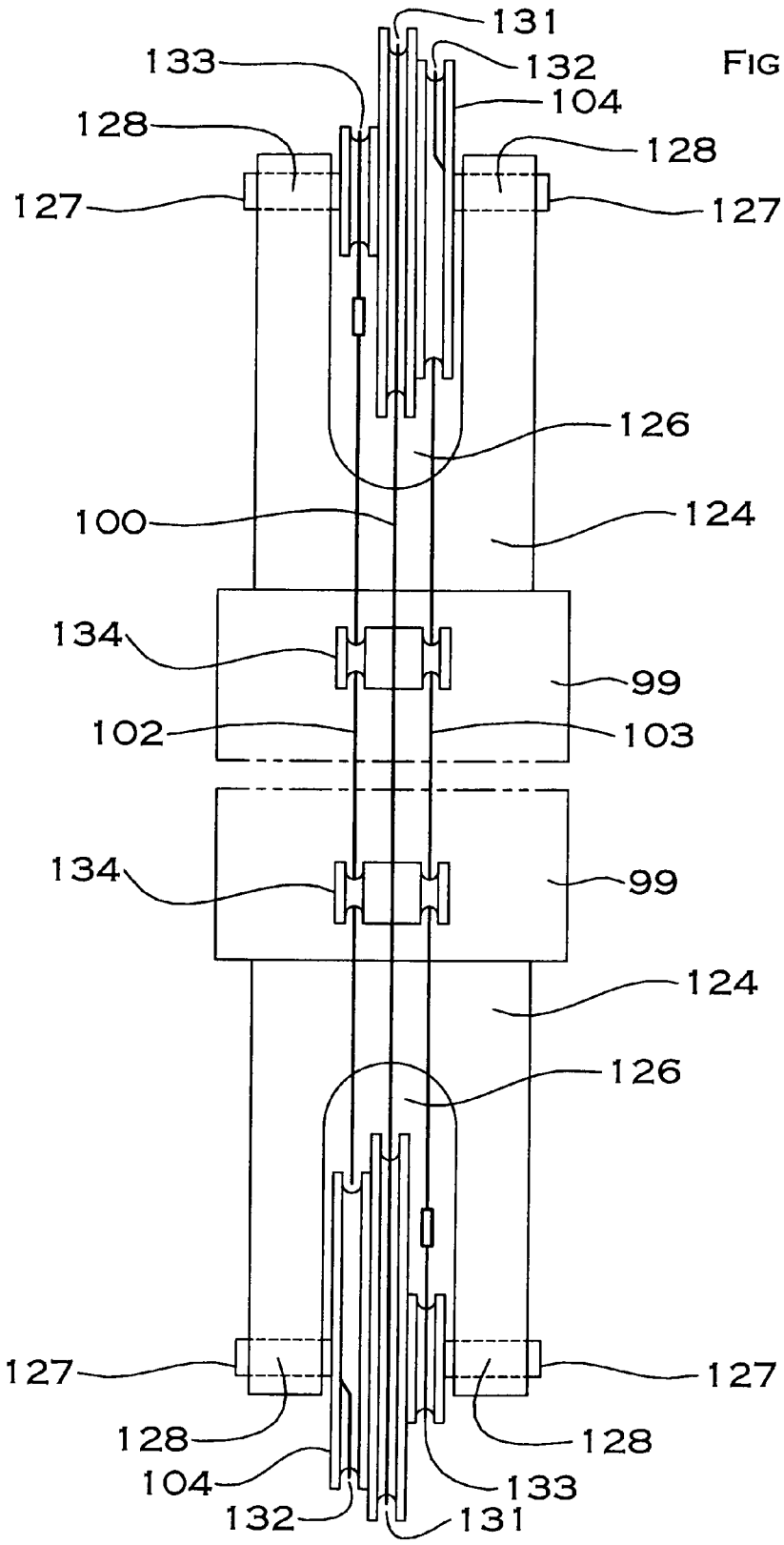

FIG. 5. Is a drawing of the pulley/actuator configuration of this invention, viewed from behind the bow, showing the power cables always aligned in line with the power cable grooves in the pulleys at all points in time and the pulleys reversed at opposite ends of the bow such that equal pressure is applied to all sides of both limbs at all points in time.

Figures 6A, 6B:
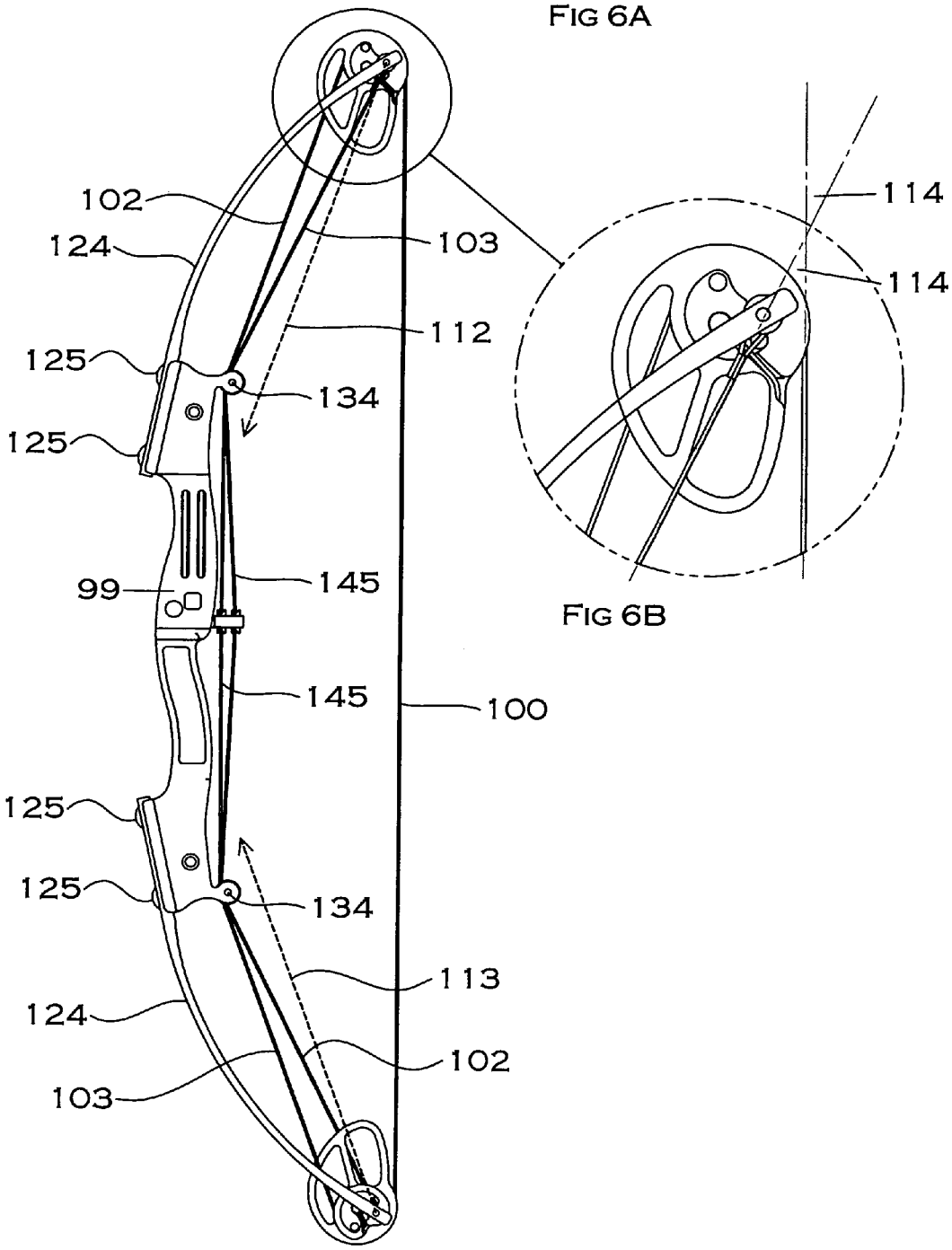

FIG. 6A is a drawing of an assembled bow of the invention (viewed from the side) showing the cable alignment between the pulleys and the cable guides at the ends of the riser, and depicting the "significant buckling beam" draw force vector that enables greater utilization of the compressive strength of the limb materials in addition to the energy stored due to the bow limbs also being bent back a distance toward the archer.

FIG. 6B is an enlarged view of the endmost portion of the bows endmost points (either end), which drawing is capable of better illuminating the details surrounding the angle of departure of the bows power cables from their termination points on each axle, with respect to the true vertical line defined by the bowstring. Dashed lines are used to project the angle inscribed by the bowstring and power cable at each end of the bow that is terminated at the same end of the bow, when the bow is at rest, with the inscribed angle, shown at a point beyond the end of the bow limb when the lines of the bowstring and power cable are extended beyond the end of the bow to a point where they would intersect when depicted in a single 2 dimensional plane, being sufficient to significantly enhance energy storage by virtue of the buckling beam energy loading forces involved. (angles of departure from true vertical greater than or equal to 17 degrees).

Figure 7A:
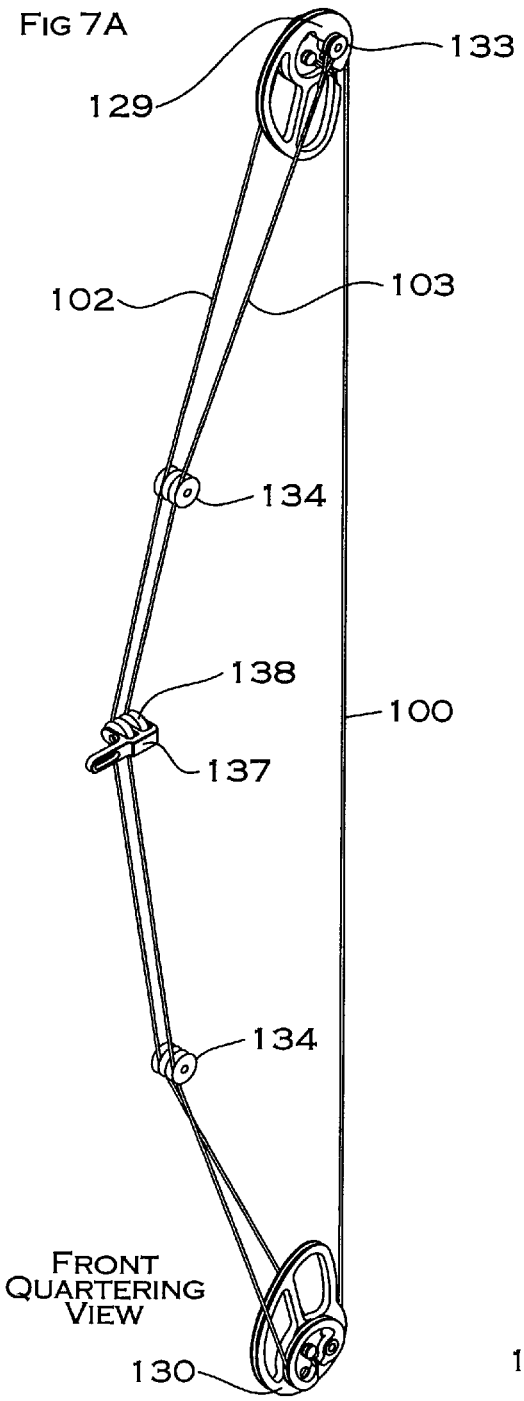
Figure 7B:
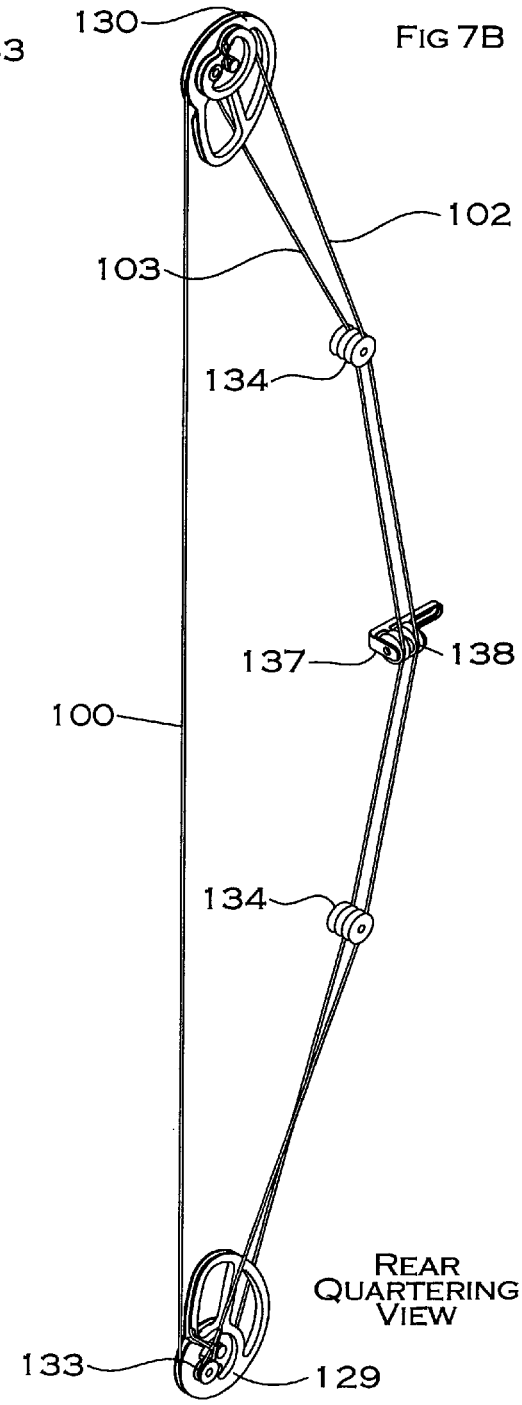
Figure 7C:
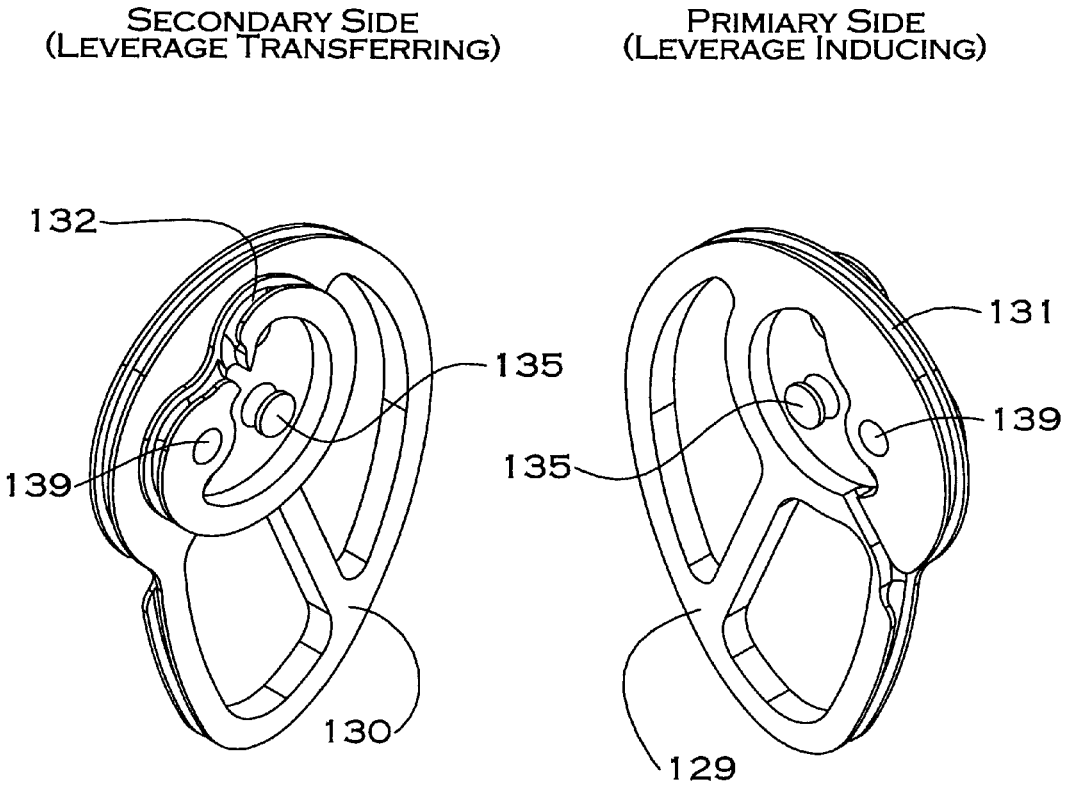

FIG. 7C depicts primary and secondary sides of typical dual planar pulleys that might be used in the invention. Both pulleys are identical in all respects. FIG. 7A and FIG. 7B both depict the two identical pulleys being reversed on their axles at opposite ends of the bow in way that results in an overall limb and pulley configuration assuring that all forces in all sections of all power cables remain equal at all point in time whether the bow be at rest, fully drawn, or somewhere in between as is further illustrated in FIG. 5.

FIG. 7A depicts actuators of the invention coupled with the pulleys in FIG. 7C as they would appear if viewed from a front-of-the-bow quartering angle, and FIG. 7B depicts the same actuators and pulleys as they would appear from a back-of-the-bow quartering angle in an assembled bow.

FIG. 7A and FIG. 7B drawings purposely do not show the limbs or riser components of the bow so as to aid in viewing the elements comprising the pulley actuator arrangement more clearly.

Drawings in FIG. 7A, FIG. 7B, and FIG. 7C are designed to make easily discernable the bowstring termination means on each pulley for one end of the bowstring, and the power cable termination means on each pulley for one end of a power cable, with the opposite end of each power cable, being terminated on the axle at the opposite end of the bow. The pulleys depicted in the drawings are examples only. Any shape of dual planar compound pulley may be used in the invention, and other power cable termination means on the pulleys may be employed as well.

Figure 8:
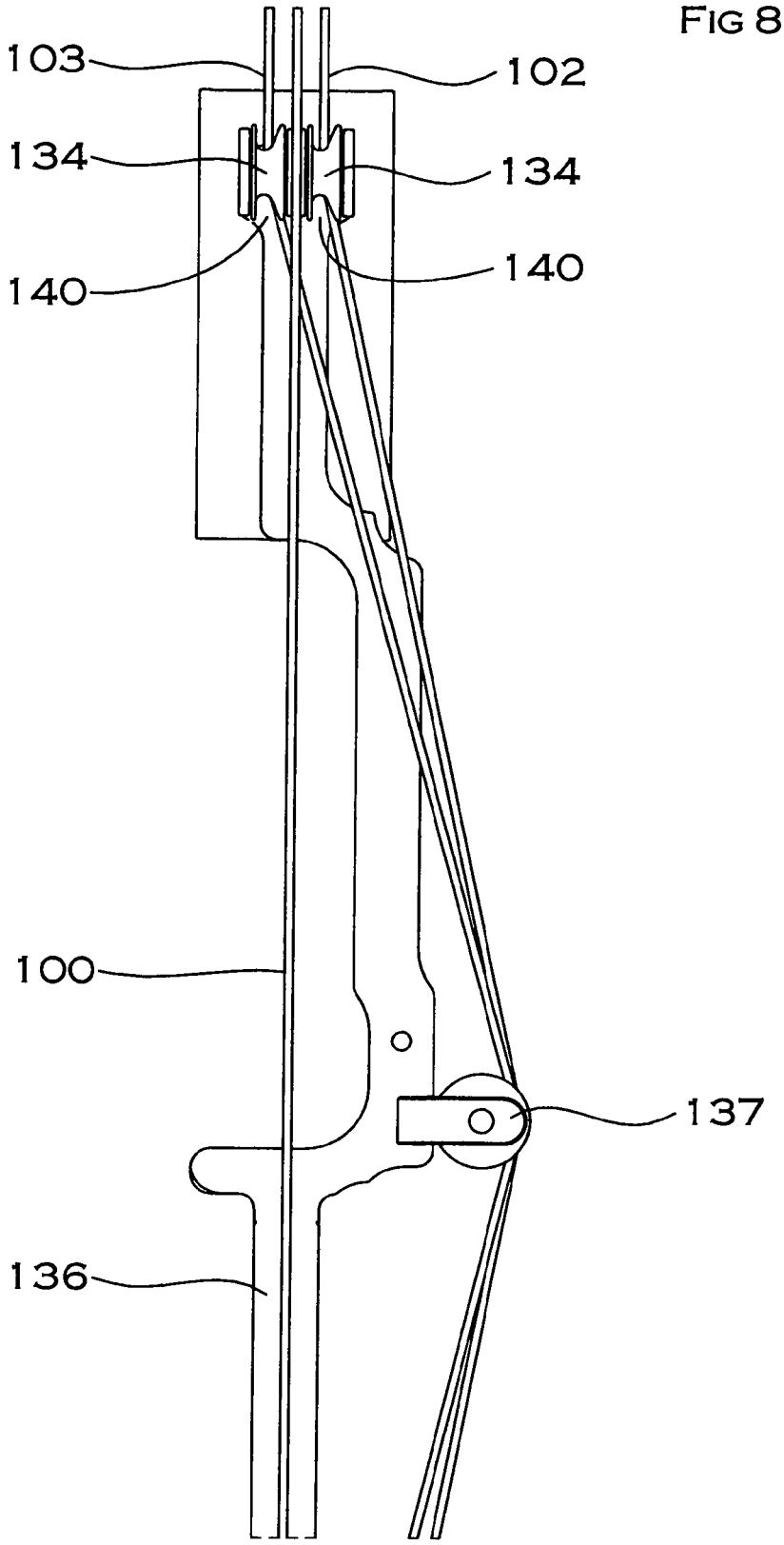

FIG. 8 is a drawing depicting the power cables re-directed away from the bows lengthwise centerline sufficiently to allow an archers bow hand to access the grip of the bow without contacting the power cables.

FIG. 9 shows a cable alignment means at each end of the riser depicted as a separate component attachable to the riser by way of an adjustable for lateral direction (clockwise/counter-clockwise) bolt and washer arrangement or swivel arrangement.

OBJECTIVES OF THE INVENTION

The objectives of this invention are to first, completely eliminate all presence of pulley related torque in the limbs and pulleys at all times during operation of a bisynchronous compound bow, whether the bow is at rest, at full draw, or at any point in between, and second, to concurrently enhance energy storage in the limb members of the bow as it is being drawn and released.

Bisynchronous operation implies that the pulley at the top end of the bow works to impart bending to the limb on the bottom end of the bow, and the pulley at the bottom end of the bow simultaneously works to impart bending to the limb at the top end of the bow. In asynchronous compound bow operation each pulley at each end of the bow operates in a way that bends only the limb it is attached to.

BACKGROUND OF THE INVENTION AND DISCUSSION OF PRIOR ART

1. Prior Art and Torque Elimination

Torque emanating from the operation of the compound pulleys in compound bows negatively affects every significant performance related area archers deem important. The performance related areas include arrow speed, penetration, arrow trajectory, accuracy, penetration at the target, ease of use, component durability, compromised strength of component parts of the bow itself, and shooter comfort. The negative effects in these performance areas have been alluded to hundreds of times over the past forty years at least and enumerated in more than 100 patent filings seeking a way to mitigate the damaging effects of limb/pulley torque in compound bows. The background section of a prior patent application by the inventor of this invention that issued as U.S. Pat. No. 6,470,870 is especially instructive in these regards and the background related content of that patent is intended to be included in full here by reference.

Figure 1:
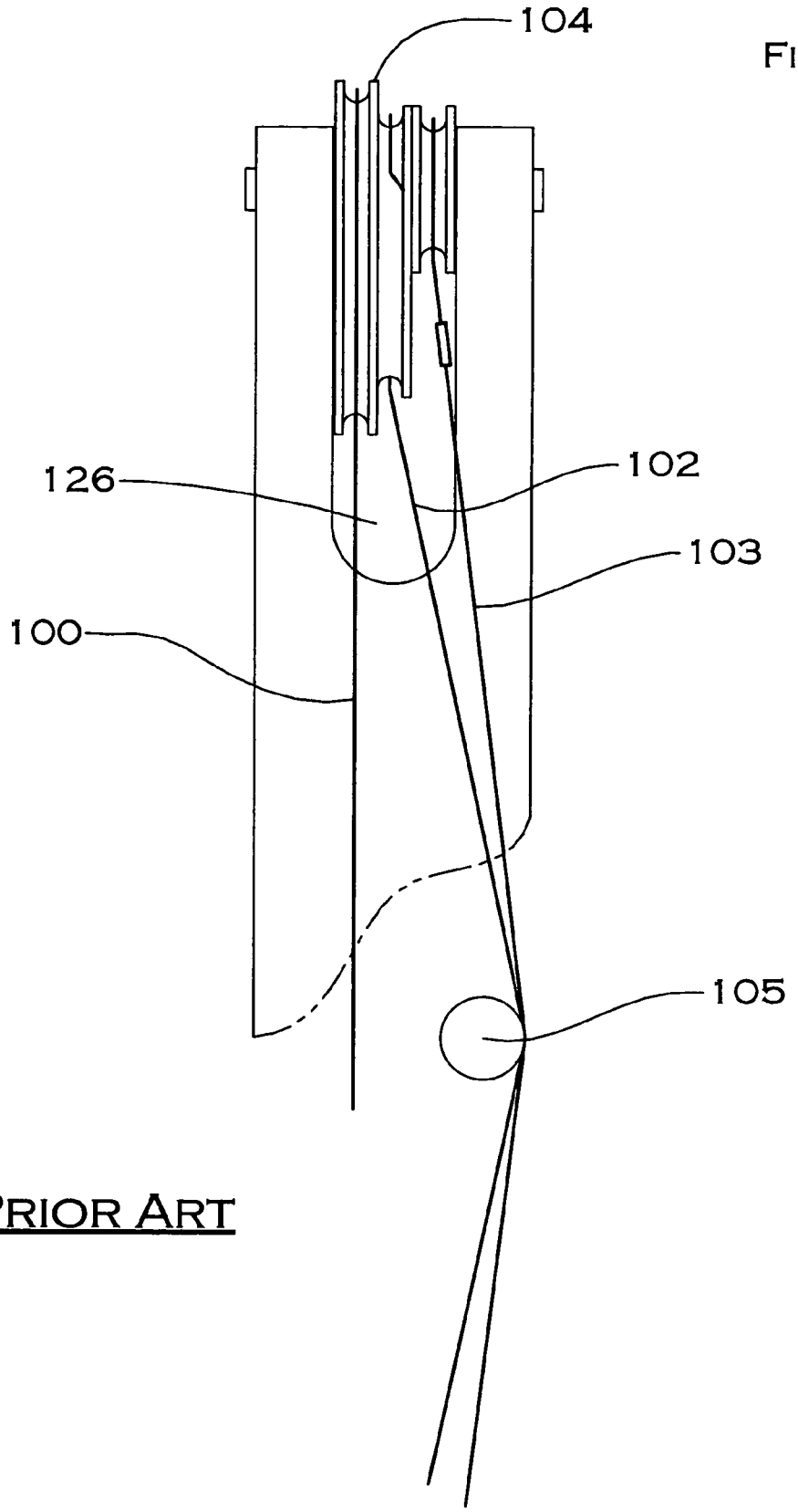
FIG 1 PRIOR ART
FIG. 1. Drawing of an early period (circa 1974) a prior art configuration showing basic pulley and power cable setup with power cables redirected away from the bows centerline enough for arrow fletching to pass by without contacting the power cable.
Figure 2:
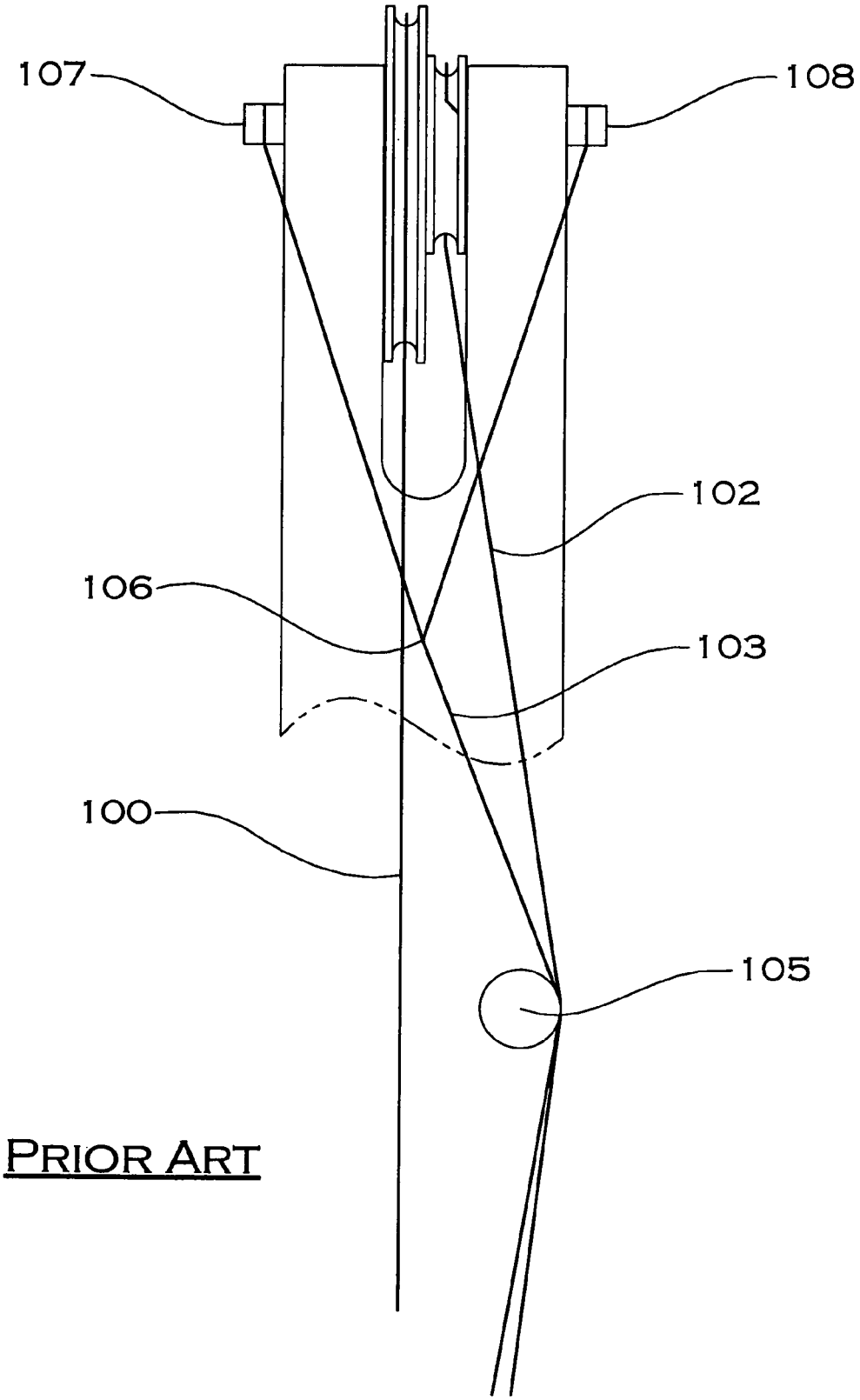
FIG. 2. Drawing of a prior art configuration showing a current day typical pulley and power cable setup with power cables redirected away from the bows centerline by a cable guard enough for arrow fletching to pass by without contacting the power cables and with at least one power cable having a split "yolk" as part of its overall makeup, with each yolk extension terminated on opposite sides of the pulley axle. This configuration is among the most used currently.
Figure 3:
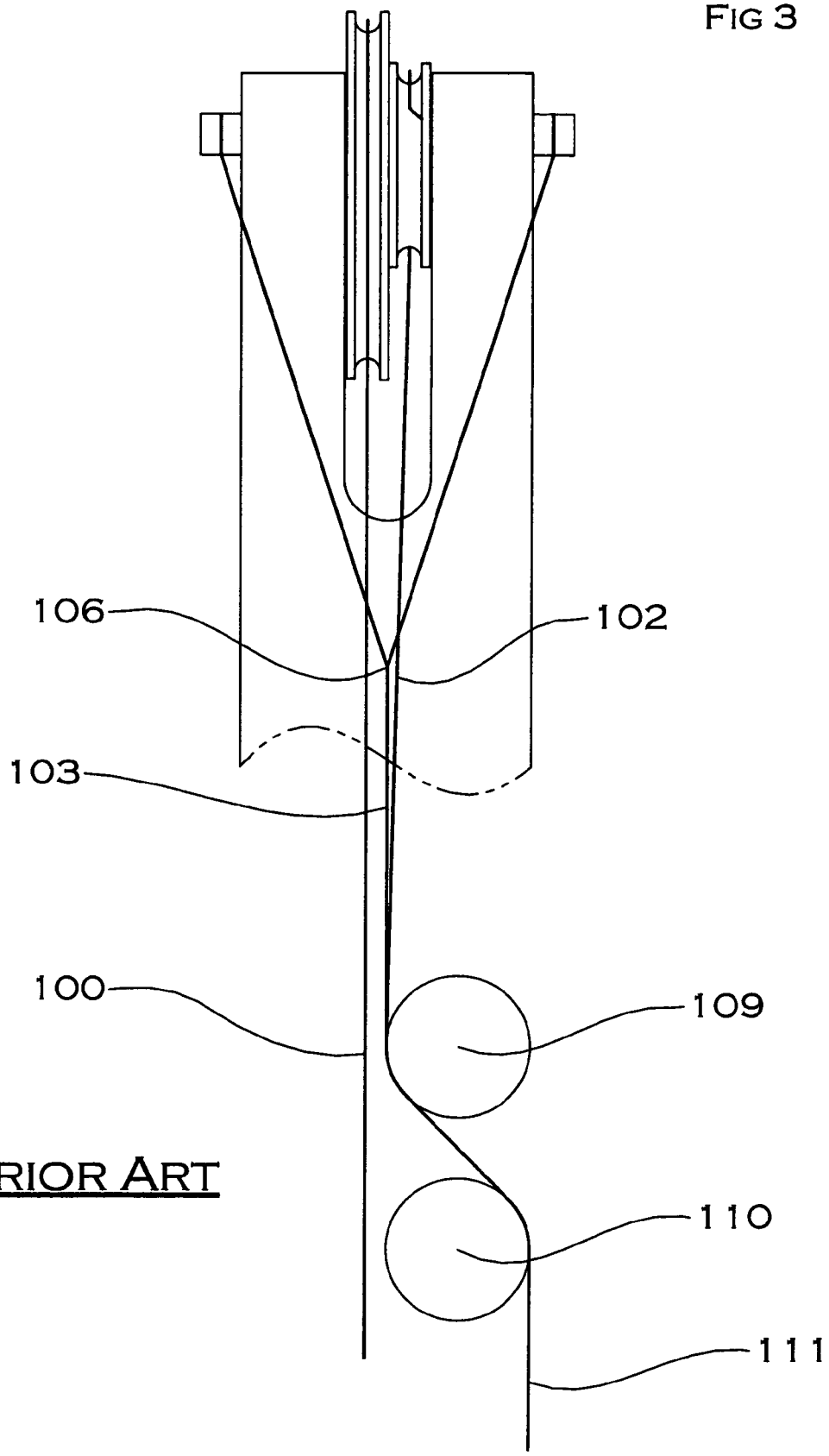
FIG. 3. A drawing similar to (Simo) invention U.S. Pat. No. 8,176,906 but designed to accommodate compound bows with dual planar pulleys as shown in FIG. 2, with two cable re-directors attached to the riser intermediate its ends, and the cable re-directors extending toward the string back to a point where the power cables (with yolks and all) pass over them and are nearly parallel to the bowstring when the bow is strung up but at rest, beginning about a pulley diameter in front of the bowstring segment of the actuator system. The Simo invention is depicted using only single planar pulleys, and no instruction is provided regarding where power cables emanate from or terminate. This drawing presupposes the Simo invention might be expanded to operate with dual planar pulleys that had a pulley groove for a bowstring side of a compound pulley and a separate take-up pulley groove for a power cable as well.

The drawings in FIG. 1, FIG. 2, and FIG. 3 all exhibit typical current and prior art approaches at mitigating the negative effects of limb/pulley torque in bisynchronous compound bows today. It should be noted that no prior or current approach aimed at eliminating limb/pulley torque in bisynchronous compound bows has actually served to eliminate the effects of limb and/or pulley torque on arrow flight in practice. Not even the smallest amount measurable.

FIG. 1 depicts a compound bow string 100 and power cable (102, 103) configuration of the early bisynchronous compound bow period (circa 1974). The power cables (102, 103) from each dual-planar pulley (104) are redirected by a cable "guard" (105) off to the outside of the bow (away from the sight pins) enough for the arrow fletching to go by without touching the power cables. This approach was found to cause both limbs on the bow to be loaded more heavily on the side the cables were redirected toward, and the net effect on shooting accuracy was essentially nil. The removal of the problem of arrow fletching hitting the cables was essentially offset entirely by increasing the amount of limb/pulley torque in the system which caused the back end of arrows exiting the bow to be pushed right/left with significant force (more force than the arrows encountered when the turkey feathers brushed by the cables prior to installing the cable "guards").

FIG. 2 depicts a refinement of the approach shown in FIG. 1. In FIG. 2, the power cables (102, 103) are configured to split (106) a distance below the axle, before passing over the cable guard (105), and proceed from the cable guard to termination points on either side of the pulley (107, 108). Initially the "split" cables were managed with steel wire ropes that first terminated on a separate component, and that component allowed different short lengths of steel cable to proceed from the division point to a tieoff point on the axle. By doing this the bow builder could direct more force to one side of the axle than the other, and in theory thereby balance the different loads going out to each side of the bow limb that the pulley was attached to. This approach later modified by introducing polymer cables in place of the wire ropes. The polymer cables could be adjusted for length by twisting or untwisting them lengthwise, and provided finer adjustment levels.

The approach used in FIG. 2, with all its many variations, predominates in the current marketplace. It doesn't actually work, not even a little bit. A particular benefit of this invention is that anyone reading the text will be educated as to why this complex and expensive approach does not work as represented.

The reason is that power cable "yolks" only work when the bow is at rest or being drawn back. They stop working instantly when the string is released because there is not a significant enough force applied to the crotch arm ends to hold them level once the string is released.

The mechanical concepts involved are pretty simple. Bows outfitted with cable yolks obviously have limb/pulley torque imbedded in the limb/pulley system. Otherwise why have yolks as part of the cables?

When the bow is first being assembled, and the pulley system is under tension, the assembler will look at the ends of the crotch arms of the bow limb to see if they are level with one another. Most likely they won't be level, indicating that one side of the pulley is pushing down harder on the axle than the other side of the pulley is when the bow is at rest. This occurs as a natural result of limb/pulley mechanical advantage in operation.

Using past experience assembling similar bows in the past, the assembler will relieve the cable tension in a bow press, and apply additional twists to the cable/yolk extension leading to the end of the crotch arm that appeared to be higher than the other, put the bow back under tension, and look again. The assembler would continue to do this until the ends of the bows crotch arms appeared level. The impression one would have at this point is that the yolks were in fact suppressing any limb/pulley torque in the system when the bow is at rest. And, at this point in time, that would be correct.

In a typical 60# peak weight compound bow, there would be about 20#-30# of downward pressure on each side of the bow limb (and each crotch arm) when the bow is pre-stressed but at rest. Twenty pounds of pressure is sufficient to hold the crotch forks level.

Then the assembler will draw the bow back to full draw, and check the forks again for being level. If they appear level at full draw, the assembler stops and the bow is ready for packaging and shipping. If there appears to be some axle tilt when the bow is at full draw, the assembler will repeat the former process until the forks appear level at full draw. This is typically called "fine tuning" of the yolk system. The impression one would have at this point is that the yolk system was in fact successfully suppressing or controlling the limb/pulley torque in the system at full draw. And, at this point in time, that would be correct.

In a typical 60# peak weight bow there would be about 60# of downward pressure on each side of the bow limb (and each crotch arm) when the bow is at full draw. The added pressure is felt by the pulleys, axles and the crotch arms, but not by the archer (that's the whole idea of "letoff"). 60# of pressure is definitely enough to hold the crotch forks level at this point in time.

Up to this point in time of the shooting cycle, on bows employing "split-yolk" cable systems, the crotch arms have been held level by a combination of limb preload pressure, muscle force and additional leverage being applied to the pulley system while the bow is being drawn back, and increased mechanical advantage enhanced pressure when the bow is at full draw.

When the string is released, the whole ballgame changes instantly. Once the string is released, the only pressure available to resist limb/pulley torque in the system is the weight of the arrow by virtue of its nock being engaged with the bowstring. The arrow will typically weigh about 1 ounce.

From that point on the limb/pulley torque imbedded in the system is pretty much completely free to do whatever it wants; and what it wants to do is instantly make the crotch arms not level.

The end result of this exercise in futility is that the pro shop operator who sells the bow must tinker a lot with the flocking point on the string, the windage of the arrow rest, and maybe even re-tinker with the factory setting in the yolk system itself, in order to get the bow shooting acceptably for the customer. None of which would have been necessary if the yolk system actually did what the person buying the bow was led to understand it did; namely eliminate the negative effects of limb/pulley torque on arrow flight.

FIG. 3 is a further and more recent modification of the basic cabling arrangement in FIG. 2. In this configuration, in addition to using one or more power cables (102, 103) having "split" yolks (106), additional power cable re-directors (109, 110,) are attached to the riser of the bow in a manner that intends each power cable to be redirected in the same direction away from the bows vertical centerline sufficiently to clear the arrows fletching as the arrow leaves the bow. The manner of redirecting the power cables in FIG. 3 calls for the power cables emanating from pulley grooves or a tieoff position on the axle at each end of the bow to initially be directed vertically substantially straight down) if from the top limb, or substantially straight up if from the bottom limb, in a line substantially parallel to the bowstring (100) when the bow is at rest, and then be offset by a redirecting apparatus (109) a horizontal distance enough to clear the arrow fletching, and then offset again by the same apparatus (110) to run vertically parallel (111) to the bowstring (100) again, until it encounters a similar cable deflector apparatus at the other end of the bow, where the power cable redirecting would again happen, but in reverse.

One such invention (Simo) U.S. Pat. No. 8,176,906 appears to be intended for use primarily on compound bows of the type that utilize a "parallel" limb mounting configuration when affixing the bows limbs to the bows riser and a single cam shaped leverage inducing pulley and a single planar pulley at the opposite end of the bow. No specifics are provided in the Simo invention relating how to expand the use to bows having dual planar leverage inducing pulleys at both ends of the bow, or limbs mounted on the riser in a substantially non-parallel (to each other) orientation, but such a configuration should be possible if the redirecting apparatus were modified to accommodate power cables coming down to the redirecting apparatus from both sides of the pulley at equal distances from the bowstring and having the bowstring situated in between the power cables up to the point where the initial power cable redirecting occurred.

2. Prior Art Limb Energy Storage and Power Cable Riggings

Energy storage in limbs affects the amount of energy that can potentially be transferred to the arrow manifesting itself in the form of velocity. As common sense would dictate, several related factors such as friction in the pulley system components, swing weights of the pulleys and axels, how far the limb is bent, and weights of the materials the limb are constructed from all play a part as well, in terms of how much actual arrow velocity emanates from a given limb/pulley configuration.

Figure 4A:
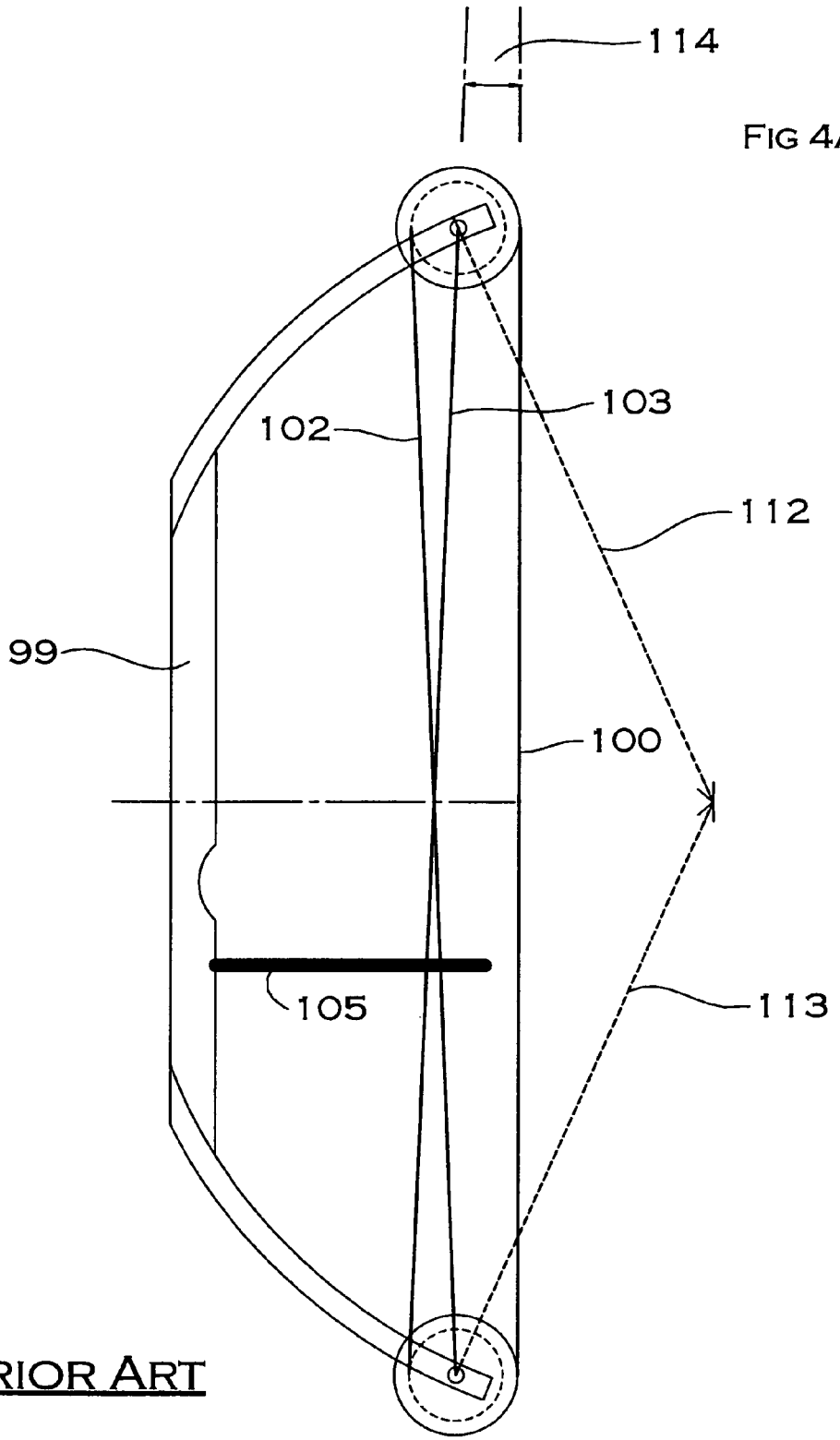
FIG 4A PRIOR ART
FIG. 4A, FIG. 4B, and FIG. 4C all show the non-buckling-beam cable arrangement of three configurations of bisynchronous prior art bows with different limb mounting approaches. Dashed lines in each of these drawings depict the approximate direction of the limb bending resultant force vector for each configuration.
Figure 4B:
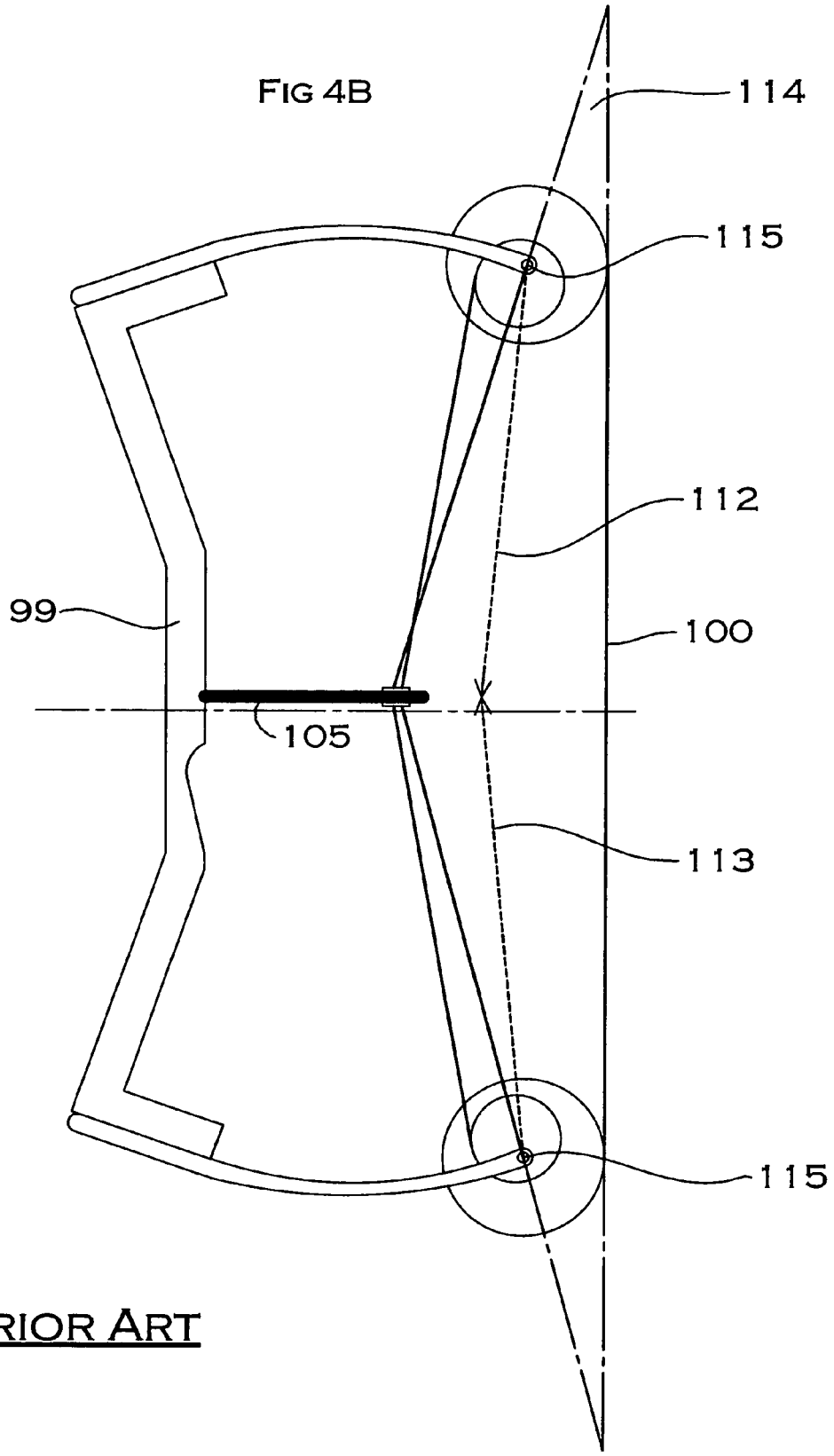
Figure 4C:
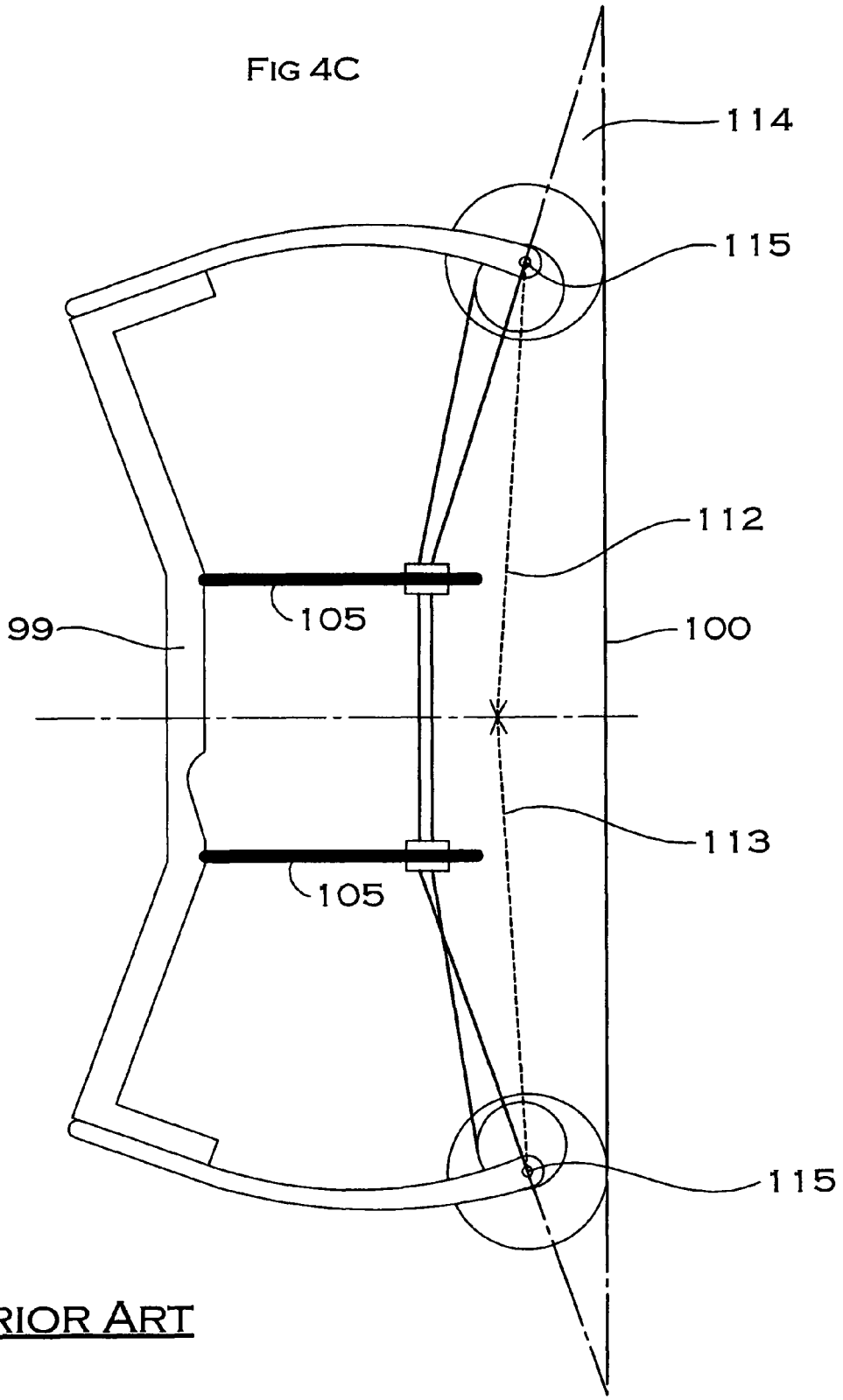

FIG. 4A, FIG. 4B, and FIG. 4C. all depict prior and current art limb/cable riggings for bisynchronous compound bows.

FIG. 4A shows a compound bow circa 1975-1990 with a typical non-parallel/cantilever limb mounting setup. The dotted lines in FIG. 4A (112, 113) approximate the resultant force vector causing the limbs to flex when the pulley system is activated.

FIG. 4B shows a compound bow with a parallel/cantilever limb mounting setup. The dotted lines in FIG. 4B (112, 113) approximate the resultant force vector causing the limbs to flex when the pulley system is activated.

FIG. 4B also illustrates the angle of departure (114) from true vertical of the power cables traveling from the cable guard (105) to the pulley axles (115), which angle is generally between zero degrees and 15 degrees.

FIG. 4C shows a compound bow with multiple cable deflectors (112,113) approximate the resultant force vector causing the limbs to flex when the pulley system is activated. FIG. 4C also illustrates the angle of departure (114) from true vertical of the power cables traveling from the cable guards (105) to the pulley axles (115), which angle is generally between zero degrees and 15 degrees.

As can be seen in each of FIG. 4A, FIG. 4B, and FIG. 4C, all relating to bisynchronous compound bows, the resultant force vectors causing limb defection in each instance (112, 113) follow paths nearly parallel to the bowstring (100) when the bow is assembled but at rest.

Figure 4D:
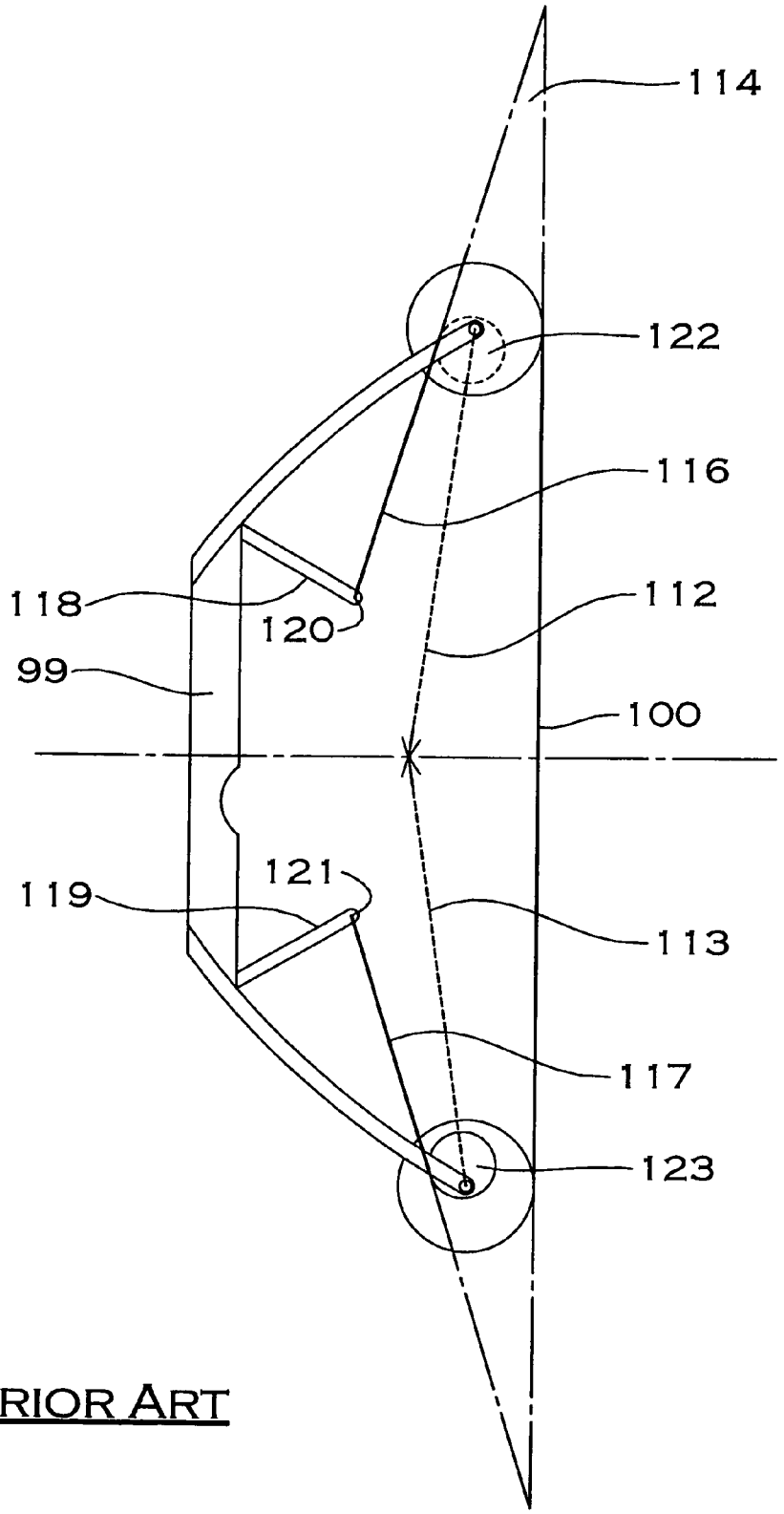
FIG. 4D depicts an asynchronous invention by this inventor that utilized a measure of buckling beam energy storage in addition to the typical down-and-back energy storage occurring in bows whose limbs are not mounted perpendicular, or nearly perpendicular, to the plane of the bows bowstring.

FIG. 4D illustrates the non-parallel power cable (116, 117) direction from an originating point on the secondary side of each pulley to a tieoff point on a flexible extension (118, 119) mounted at the same end of the bows riser in an asynchronous compound bow configuration as in U.S. Pat. No. 6,470,870. The dotted lines in FIG. 4D (112, 113) approximate the resultant force vector causing the limbs to flex when the pulley system is activated. FIG. 4D also illustrates the angle of departure (114) from true vertical of the power cables traveling from the termination points on the extensions (118, 119) members attached to the bows riser (99) to the pulleys secondary sides (122, 123), which angle varied between 10 degrees from true vertical and 15 degrees from true vertical, depending how far back from the bows vertical centerline the actuator termination point was located on extensions attached to the bows riser.

Two such asynchronous inventions U.S. Pat. Nos. 6,470,870 and 6,792,931 by this inventor also utilized a power cable arrangement that called for the power cables to proceed from the groove in the take-up side of the pulley they emanated from at an angle forward toward the end of the riser at the same end of the bow that the pulley and its related limb were mounted on. This provided additional energy storage in the limbs due to the addition of a buckling beam element that added to the typical cantilever bending moments of resistance as the bow was drawn back. FIG. 4D illustrates the non-parallel power cables (116, 117) direction, with respect to the bowstring (100), to a tieoff point (120,121) on a flexible extension member (118, 119) mounted at the same end of the bows riser as in U.S. Pat. No. 6,470,870. In practice, both of these asynchronous inventions were found to be unacceptably critical of hand position on the grip of the bow, regardless of the length of the flexing or rigid member they were terminated on, and were prone to having the pulleys at opposite ends of the bow rotate at different rates as the bow was drawn, and were abandoned.

Two other asynchronous compound bow inventions (Jones, U.S. Pat. No. 4,227,509 and Groves U.S. Pat. No. 3,993,039) also utilized elements of the buckling beam limb bending approach in different contexts to achieve energy storage. The Jones invention utilized a triangular lever arm attached to an arcuated limb that caused the limbs to bend down and forward, away from the archer. The excessive weights at the end of each limb related to the large triangular levers were possibly the greatest deterrent to commercialization of this invention.

The Groves invention utilized power cables that relied on pulleys mounted outside of the bows limbs, exacerbating torque problems. The Groves invention also had power cables extending over the face side (facing the target) side of the bows limbs which emitted unacceptable levels of noise when the bow was shot.

Neither the Jones nor Groves inventions achieved a significant presence in the marketplace. Both of these inventions were discussed in detail in the background section of U.S. Pat. No. 6,470,870, the background section of which patent is intended to be included here in full by reference.

SUMMARY OF THE INVENTION

The invention relates to a new way of configuring an archer's bisynchronous compound bow such that uneven forces emanating from opposite sides of identical dual-planar compound pulleys mounted near the ends of each of the bows limbs do not register as torque in the bows limbs or pulleys at any point in time. The invention further introduces in bisynchronous compound bows a bowstring and dual power cable configuration that provides a significant measure of buckling beam energy storing in the bows limbs in addition to the normal energy storage emanating from a cantilevered limb mounting arrangement used to affix the bow limbs in place on the bows center or riser section.

The elimination of limb/pulley torsion in the bow serves to improve every performance related characteristic that archers have deemed important over the years since compound bows were successfully introduced into the marketplace. These include arrow speed, penetration, trajectory, accuracy, ease of use, quiet shooting, shooter comfort and component durability.

The introduction of a significant amount of buckling beam energy in addition to the normal energy stored in cantilever mounted bow limbs provides a benefit in that limbs of a given length, width, thickness and material construction can be made thinner to achieve a given desired draw weight in the bow, and this in turn reduces the amount of the energy stored in the limbs required to get the limbs themselves underway when the archer releases the string. The resulting lighter limb weights contribute to more of the total amount of stored energy in the limbs being made available for accelerating the arrow out of the bow, and less swing weight in the limbs themselves, which condition further contributes to less residual vibration and noise coming from the bow at the end of the acceleration stroke.

The invention assumes a typical component set comprised of a bow riser with limbs affixed to each end, and each bow limb housing a dual-planar compound pulley mounted on an axle proximate its endmost point. Dual planar implies that the pulley has two adjacent pulley sides existing in separate planes of operation. Also included in the overall bow configuration are two power cables and a separate bowstring segment comprising the pulley actuators for the bow. In these regards the invention is similar to many compound bows now being made.

The inventive pulley actuator subsystem of the bow is configured in a unique, improved, non-obvious (prior to this application), easier to manufacture, and more useful combination than has been the case to date with the deployment of similar component sets in bisynchronous compound bows now, or previously, being marketed. The inventive differences and advantages of the invention will become self-evident to those skilled in the art when viewing a description of a preferred embodiment of the invention which follows.

DESCRIPTION OF THE PREFERRED EMBODIMENT OF THE INVENTION

Following is what the inventor considers an optimal embodiment of the invention. The preferred embodiment described is but one of many possible configurations of the elements comprising the invention as specified in the claims. Those knowledgeable in the art will be able to discern other embodiments that might also work well. In fact the number of alternate possibilities, all falling within the scope of the claims, is considered to be a benefit of the invention, by allowing many variations on a theme in the marketplace.

The preferred embodiment shown here will be sufficient to allow those skilled in the art to construct a working model which incorporates all of the elements claimed in the invention.

FIG. 6A shows a drawing of a side view of a bisynchronous compound bow depicting all of the elements of the invention. The preferred embodiment utilizes a center or riser component (99) to which a resilient limb member (124) is affixed by means of a bolt or bolts (125) in position proximate each of its ends. Opposing limb members are identical in all respects.

FIG. 5 illustrates how each resilient limb member incorporates a relieved crotch area (126) with the open area of the crotch defined on each side by a crotch arm. Each crotch arm incorporates a horizontal axle hole (128) suitable for accepting an axle (127) that in turn engages and supports in rotational manner a dual planar compound pulley (104). Crotches in each limb are centered lengthwise substantially congruent with respect to the lengthwise centerlines of each limb.

FIG. 7C shows a dual planar pulley of the invention viewed from both the primary side (129) and secondary side (130). Each compound pulley incorporates a primary side (129) and a related primary pulley side groove around its circumference (131) sufficient in width to receive a bowstring actuator segment, and a secondary (take-up) pulley side (130) and related secondary groove around its circumference (132) sufficient in width to receive a power cable actuator segment. Each pulley incorporates a horizontal hole (139) suitable for receiving an axle FIG. 5, (128) for the pulley to rotate around during operation of the bow.

Dual planar as related to the pulleys of the invention as depicted in FIG. 7C refers to the fact that the compound pulleys of the invention have two sides, comprised of a first leverage inducing (primary) side (129) and a second leverage transferring (secondary) side (130) which exist in two separate planes of operation. The planes representing the circumferences of the two grooves in the pulley may be parallel to one another or not parallel to one another. In the preferred embodiment shown here, the two grooves lie in planes parallel to one another.

The pulleys deployed at each end of the bow are identical. There is not a requirement therefore for tooling up a "top" pulley and a "bottom" pulley.

FIG. 5, FIG. 7A, and FIG. 7B all illustrate how the pulleys when mounted on the axles are reversed with respect to one another. FIG. 5 shows how the primary pulley groove in each pulley (131) at each end of the bow is substantially aligned with the plane containing the vertical centerline of the bows limbs), and how the actuator grooves (132) in the secondary sides of the pulleys mounted on limbs at opposite ends of the bow are on opposite sides of the primary pulley side's actuator groove in each instance at opposite ends of the bow.

FIG. 5 further illustrates a rotatable means (133) of terminating one end of a power cable that emanated from the secondary side of a pulley at the opposite end of the bow. The rotatable termination means is located adjacent the primary side of each pulley, when mounted on its axle. The horizontal distance from the center of the groove in the secondary (take-up) side of the pulleys at each end of the bow to the center of the groove in the primary (bowstring) side of the same pulley will, in the preferred embodiment, be substantially equal to the horizontal distance from the center of the groove in the primary side of the same pulley to the center of the groove in the rotatable termination means adjacent to the primary side of the pulley mounted on the same axle at the same end of the bow.

FIG. 7C shows a suitable dual-planar pulley of the invention viewed from both the primary (129) and secondary (130) sides in a quartering view. The quartering 3D view assists in viewing the pulley grooves in each side of the pulley, and illuminating the details related to the actuator termination means incorporated in both the primary and secondary pulley sides.

The ends of each power cable actuator segments shown in FIG. 7A and FIG. 7B of the overall actuator sub-system that are not terminated on the axle mounted rotatable termination means are terminated on the secondary side of the pulleys at each end of the bow at termination busses integrated into the pulleys provided for that purpose FIG. 7C, (135). The bowstring actuator segment of the pulley system is likewise terminated on each pulley at each end of the bow at a similar integral termination buss FIG. 7C, (135) provided for that purpose on the primary pulley side of each pulley, after being wrapped around the outside circumference of the primary side of the pulley.

FIG. 5 further illustrates how, once secured in place at their termination points on each pulley, the power cable actuator sections (102, 103) proceed in parallel fashion to power cable alignment guides (134,) provided at each end of the riser component.

FIG. 8 depicts the cable alignment guides at each end of the riser incorporating receiving grooves or rollers FIG. 8, (140) that have the receiving grooves or rollers spaced horizontally so that the parallel alignment of the power cables is maintained for their entire length (as shown in FIG. 5), from where they pass under the rollers incorporated in the cable alignment guides up to and including the point where each is terminated on a termination buss FIG. 5, (133) mounted on an axle at the same end of the bow.

FIG. 9 shows an alternate embodiment of the cable alignment guides incorporating a swivel mounting means. However, the preferred embodiment calls for cable guides that are fixed in a single alignment position and integrated into the ends of the riser component.

The most likely method of termination of all ends of all actuator segments will be simple bowstring loops at each and of each actuator segment. The loops would be configured in size to fit the tieoff buss they were intended to be terminated on.

FIG. 7A and FIG. 7B further depict the pulley-actuator sub system of the invention by themselves. The bowstring (100) is terminated at each end on a termination buss integrally incorporated in the primary side of each pulley as shown in FIG. 7C (135). Each power cable is terminated at one end on a rotatable termination means (133) located on the axle proximate the primary side of the pulley at the same end of the bow and at its opposite end terminated at the termination buss integrally incorporated in the secondary side of the pulley. Both FIG. 7A and FIG. 7B also depict a cable deflector means (137) that is described in greater detail when viewing and describing features illustrated in FIG. 8 (137).

Up to this point in describing a preferred embodiment of the invention the descriptions have centered on maintaining all actuator sections in parallel with each other over the entire length of the bow. Such a construction assures that since the bows limbs are identical, and the bows pulleys are identical, and the crotch housings for each pulley are centered lengthwise in each limb, the forces related to each power cable registering on each limb will also be identical at all points in time whether the bow is being drawn, released or at any point in between. Thus limb-pulley torsion in the overall system is eliminated.

In order to be useful as an archers bow however, the power cables will have to be removed a distance from their parallel positions in the area immediately below the center of the riser, where the archers bow hand would rest on the bow FIG. 8, (136).

Toward that end, in this embodiment of the invention, a power cable deflector means is incorporated in the riser component as shown in FIG. 8, (137), FIG. 7A (137), and FIG. 7B (137). The cable deflector means in this embodiment incorporates rollers as shown in FIG. 7A and FIG. 7B, (138) and is positioned to maintain the power cables at a substantially constant attitude and elevation between the cable alignment guides proximate each end of the riser as shown in FIG. 6 (145), and which positioning provides that the power cables attitude between the cable alignment guides proximate each end of the riser component appears to be parallel or nearly parallel with the plane containing the bowstring actuator segment.

However this is not a requirement of the invention. Any means of relocating the power cables out of the way of the archers bow hand at any elevation with respect to the cable guides proximate the riser ends will suffice regardless of the attitude or elevation of the power cables between the cable alignment guides at or near the risers ends.

The parallel and equidistant relationship between the power cables and the bowstring segments of the actuator system are preserved in their entirety from the location of the cable alignment guides located proximate each end of the riser, to the axles, pulleys, and power cable termination busses at the same end of the riser as the power cable alignment guides at each end of the bow, and this configuration is sufficient to assure that there can be no possibility of torsion ever registering in the bows limbs, pulleys, axles, bowstring, or power cable segments, and therefore no torsion misdirected arrow flight.

FIG. 8 illustrates how all sideways forces registering in the power cables would register only upon the cable redirector guides (137) and the toward-center edges of the rollers in the cable alignment guides (140) at each end of the riser. No torque would (or could) register in the limbs, pulleys, axles or bowstring actuator sections with this configuration.

FIG. 6A again shows the inventive preferred embodiment from the side. In this view the bow is at rest, but the limbs have been pre-stressed, and there is tension on all of the actuator sections.

When configured in this manner, the power cables (102, 103) can be seen to be directed from their at rest positions directly toward the cable alignment guides at each end of the riser (134).

FIG. 6B is an enlargement of the end-most parts of the bow. FIG. 6B is included to better depict the angle of departure of the bows power cables from the true vertical direction described by the bowstring. As can be observed from FIG. 6B, the power cables are directed at an angle (114) significantly forward from true vertical toward the ends of the bows riser, at each end of the bow, rather than being directed substantially straight down as in prior art bisynchronous bows.

When so directed in a bisynchronous bow configuration, the cables impart an added and, depending on the degree of departure from true vertical of the power cables from their termination points on the axles, very significant "buckling beam" element of energy storage in the limbs, in addition to the energy stored in the limbs from a conventional cantilever bending configuration with power cables directed more or less substantially straight up-down as in prior art bows.

In FIG. 6A, the dotted lines (112, 113) represent typical resultant bending force vectors that would register in the bows limbs as the bow is being drawn. These directional draw force vectors impart additional buckling beam related energy into the overall energy storage in the bows limbs during operation of the bow.

The greater the angle of departure of the power cable actuator sections from true vertical from their termination points on their related axles to the cable alignment guides, the greater the degree of additional energy stored in the limbs due to the additional "buckling beam" energy storage effects.

Minor amounts of forward-angled power cable directed forces do not appear to affect overall energy storage in the limbs significantly. When the power cables proceed from their termination points on the bows axles to the point where they contact the cable alignment guides or rollers at angles greater than 15 degrees from true vertical, the effects of additional limb bending and the resulting enhanced energy storage become increasingly noticeable as the angle of departure from true vertical increases.

In the preferred embodiment shown in FIG. 6A and FIG. 6B, the angle of departure from true vertical of the power cables from their tieoff points on their respective axles (114) is approximately 28 degrees. Angles of departures of this magnitude from true vertical of the power cable actuator segments from their termination points on their related axles will typically increase energy storage in a given limb member somewhere within a range of a very significant 80% to 120% depending on the length of the bows limbs, amount of preload in the limbs when the bow is assembled but at rest, the overall draw length of the bow as programmed into the bows pulleys, and the initial brace height of the bow string.

FIG. 9 depicts an alternate embodiment of one aspect of the invention, namely it incorporates rotatable cable alignment guides at each end of the bow riser that can have their directional alignment adjusted by way of a bolt and washer arrangement securing the cable alignment housing to the riser. The guide rollers (140) are assembled in a housing component (141) so as to rotate around an axle (142). The housing is secured to the end of the bows riser (99) by a bolt (143) and washer (144) arrangement.

Beyond the distinctions enumerated in this section of the patent application, the inventive bow operates in the normal bisynchronous compound bow fashion with the typical unwrapping of bowstring cable during drawing of the bow, the simultaneous wrapping up of power cable actuator segments around the secondary side of each pulley, and with the pulley mounted at the top of the bow bending the limb at the bottom of the bow, and vice versa, and the pulleys acting as a compound pulleys.

The significant differences are that in this invention, there is no possibility of torsional forces registering on the bows limbs, pulleys, axles, or bowstring actuator segment at any point in time whether the bow is at rest, fully drawn back or at any point in between due to the unique pulley-cable-actuator configuration, and the amount of energy storage in each limb of the bow is enhanced absolutely equally and significantly over any prior art bisynchronous compound bow invention by virtue of the addition of significant buckling beam related energy storage to the system. These distinctions even if taken separately but certainly when taken together create an invention that is superior to any and all other compound bow inventions that have preceded it.

Short Summary of Arguments Supporting Patent Issuance:

1. The Invention Teaches Against the Prior Art.

The power cable arrangement wherein the power cables are directed at a significant angle away from true vertical as defined by the bowstring, while maintaining a substantially parallel relationship with each other as the means of eliminating limb/pulley torsion in the system is contrary to the teachings of all other bisynchronous compound bow inventions.

2. The Invention Employs a Unique Combination of Elements in Meeting Two Previously Unmet Needs in Compound Bows Configured in a Bisynchronous Manner.

The aspect of the invention that calls for the power cables to be directed to points on the riser ends in a manner that increases the buckling beam energy storage potential in the limb members, while eliminating the need for an intermediate point along the riser for the limbs to bend over, which combination has been typically deployed to achieve the same purpose in prior art bows, combined with the unique power cable rigging that maintains a parallel relationship between opposing power cables from the ends of the limbs to the cable alignment guides at each end of the bows riser and which calls for reversed pulley deployment at opposite ends of the bow achieves the unique combination of completely eliminating pulley induced torque in the limbs and pulleys and simultaneously enhancing energy storage in the limb members, which combination has not been achieved before in prior art bisynchronous compound bows.

3. The Invention Provides a Significant and Desirable Benefit Never Before Achieved in Bisynchronous Compound Bows.

The total elimination of limb/pulley torque in a manner that could otherwise adversely affect arrow flight is a significant advance in the state of the art in bisynchronous compound bows. All prior art inventions seeking this benefit have worked rather to only mitigate the problem, or like the cable "yolk" approaches that predominate in the current market, have no real measurable effects on limb/pulley torque at all.

Having provided a detailed description of the background of the prior art, a summary of the invention, detailed drawings, and a detailed description of a preferred embodiment of my invention, and a summary of arguments supporting issuance of the patent being applied for, I now claim the following:

1. A bisynchronous compound bow comprised of:

a. a center riser section with two ends and a distance between the ends, and a place proximate the center of the riser length configured for an archer to grip the bow; with each end of the riser section providing a means of attaching a bow limb; and a means proximate each end of the riser of incorporating directional power cable alignment guides for power cables on the bow, and further providing a means for holding the power cables between the ends of the riser for moving the power cables away from a centerline of the bow sufficient to clear an archers bow hand;

b. two bow limbs, with each limb having a base section suitable for attaching the limb to the riser, a flexible length separating the opposite ends of each limb, and an opposite limb end section configured to accommodate mounting and rotation of a dual planar compound pulley, and an axle for the dual planar compound pulley to rotate around and space on the axle for one end of one of the power cable to be terminated;

c. two identical dual planar compound pulleys with each dual planar compound pulley having a primary bowstring side with an outside groove around its circumference to accept the bowstring and a termination point on the primary side of the dual planar compound pulley for one end of the bowstring, and each dual planar compound pulley having a secondary power cable takeup side with an outside groove around its circumference to accept one of the power cable, and a termination point on the secondary side of the pulley for one end of one of the power cable, and each dual planar compound pulley having an axle hole to accept the axle that the dual planar compound pulley rotates around;

d. three separate actuators used to operate the dual planar compound pulleys on the bow, with a first actuator serving as the bowstring, constructed of suitable bowstring materials, with a loop at each end suitable for terminating on an attachment point on the primary side of each dual planar compound pulley at each end of the bow, and two other separate actuators serving as the power cables, each made of suitable power cable materials, and each having loops at both ends where one end loop of each power cable actuator terminated on an attachment point on the secondary side of the dual planar compound pulley at one end of the bow, and after proceeding through cable alignment guides at each end of the bows riser, the opposite end loop of the power cable actuator will be terminated at a place provided on the axle of the dual planar compound pulley at the opposite end of the bow, with all three actuators acting in concert to apply leverage used to bend the limbs on the bow as the bow is drawn and released;

e. the two identical dual planar compound pulley mounted on the limbs at opposite ends of the bow in reverse fashion with respect to one another such that the pulley at one end of the bow is mounted on the axle with the secondary side of the pulley on one side of the bowstring, and the pulley at the opposite end of the bow is mounted on the axle with the secondary side of the pulley located on the opposite side of the bowstring, with bowstring and power cable segments further configured so that the bowstring segment lies in a plane substantially congruent with a plane that contains a vertical centerline of the limbs when mounted in place on the riser of the bow, and the two power cables lie in planes substantially parallel to the plane contacting the vertical centerline of the limbs, at substantially equal distances from, but on opposite sides of the bowstring, and;

f. the power cables and the bowstring actuator segments further configured such that each power cable has one end secured to a location on the secondary side of the dual planar compound pulley located at one end of the bow limb attached to one end of the bow riser, from which secured location on the dual planar compound pulley the opposite end of the power cable first engages the groove in the secondary side of the pulley and then travels through the cable alignment guides located proximate both ends of the riser to a point where it terminates at a place provided along the axle located at the opposite end of the bow; with the section of power cable that extends from the cable alignment guide location on the riser to a termination point on the axle at the same end of the bow when the bow is assembled but at rest, describing an angle greater than or equal to 17 degrees with respect to a vertical direction described by the bowstring, where a straight line representing an extension of the bowstring beyond the end of the bow and a straight line representing an extension of the power cable beyond the same end of the bow when viewed from the side and rendered in two dimensions would intersect.

* * * * *